US008556462B2

(12) United States Patent
Huang

(10) Patent No.: US 8,556,462 B2
(45) Date of Patent: Oct. 15, 2013

(54) LED LIGHTING DEVICE

(75) Inventor: David Huang, Taipei (TW)

(73) Assignee: Liquidleds Lighting Corp., Taipei (TW)

( * ) Notice: Subject to any disclaimer, the term of this patent is extended or adjusted under 35 U.S.C. 154(b) by 441 days.

(21) Appl. No.: 12/851,542

(22) Filed: Aug. 5, 2010

(65) Prior Publication Data

US 2012/0032577 A1 Feb. 9, 2012

(51) Int. Cl.
*F21V 21/00* (2006.01)
*F21V 7/00* (2006.01)
*F21S 13/14* (2006.01)

(52) U.S. Cl.
USPC ..... 362/249.02; 362/235; 362/249.01

(58) Field of Classification Search
USPC ..... 362/249.02, 235, 249.01, 249, 800
See application file for complete search history.

(56) References Cited

U.S. PATENT DOCUMENTS

| | | | | |
|---|---|---|---|---|
| 7,086,756 | B2 * | 8/2006 | Maxik | 362/249.04 |
| 2009/0135595 | A1 * | 5/2009 | Chen | 362/235 |
| 2010/0254139 | A1 * | 10/2010 | Juang | 362/249.02 |

* cited by examiner

*Primary Examiner* — Joseph L Williams
(74) *Attorney, Agent, or Firm* — Hershkovitz & Associates, PLLC; Abe Hershkovitz

(57) ABSTRACT

An LED lighting device has a cap, a circuit board assembly and a bulb envelope. The circuit board assembly is electrically mounted on the cap and has multiple circuit boards intersecting to each other to form a light frame with a crisscross section, and has multiple LEDs mounted on the circuit boards. The circuit board assembly may further have a top circuit board mounted on one end of the light frame. The top circuit board also has multiple LEDs mounted thereon. Sine the circuit boards intersect to each other to constitute the light frame, the light frame provides a large surface area for mounting a lot number of LEDs. Therefore, the LED lighting device is able to provide a wide angle illumination with enhanced lighting intensity.

19 Claims, 10 Drawing Sheets

LED LIGHTING DEVICE

BACKGROUND OF THE INVENTION

1. Field of the Invention

The present invention relates to a lighting device, and more particularly to an LED lighting device with a wide angle illumination.

2. Description of Related Art

Since power consumption of lighting emitting diode (LED) is relatively low, more and more LED-based lighting device are available in the market and substitute conventional illuminating elements. With reference to FIG. 10, a conventional LED lamp mainly comprises a circular circuit board 50 with multiple LEDs 51 mounted thereon to emit light.

The light generated by the LEDs 51 is directional. If the LEDs 51 are mounted on the same plane, the light from the LEDs 51 will irradiate toward the same direction. Therefore, the conventional LED lamp is unable to provide a wide angle illumination area.

To overcome the shortcomings, the present invention provides an LED lighting device to mitigate or obviate the aforementioned problems.

SUMMARY OF THE INVENTION

The main objective of the invention is to provide an LED lighting device with a larger area for mounting multiple LEDs that emit light toward different directions to achieve a wide angle illumination.

An LED lighting device in accordance with the present invention comprises a cap, a circuit board assembly and a bulb envelope. The circuit board assembly is electrically mounted on the cap and has multiple circuit boards intersecting to each other to form a light frame with a crisscross section, and has multiple LEDs mounted on the circuit boards. The circuit board assembly may further have a top circuit board mounted on one end of the light frame. The top circuit board also has multiple LEDs mounted thereon. Sine the circuit boards intersect to each other, the light frame has a large surface area for mounting a lot number of LEDs. Therefore, the LED lighting device providers a wide angle illumination area with enhanced lighting intensity.

Other objectives, advantages and novel features of the invention will become more apparent from the following detailed description when taken in conjunction with the accompanying drawings.

DETAILED DESCRIPTION OF PREFERRED EMBODIMENT

Figure 1:
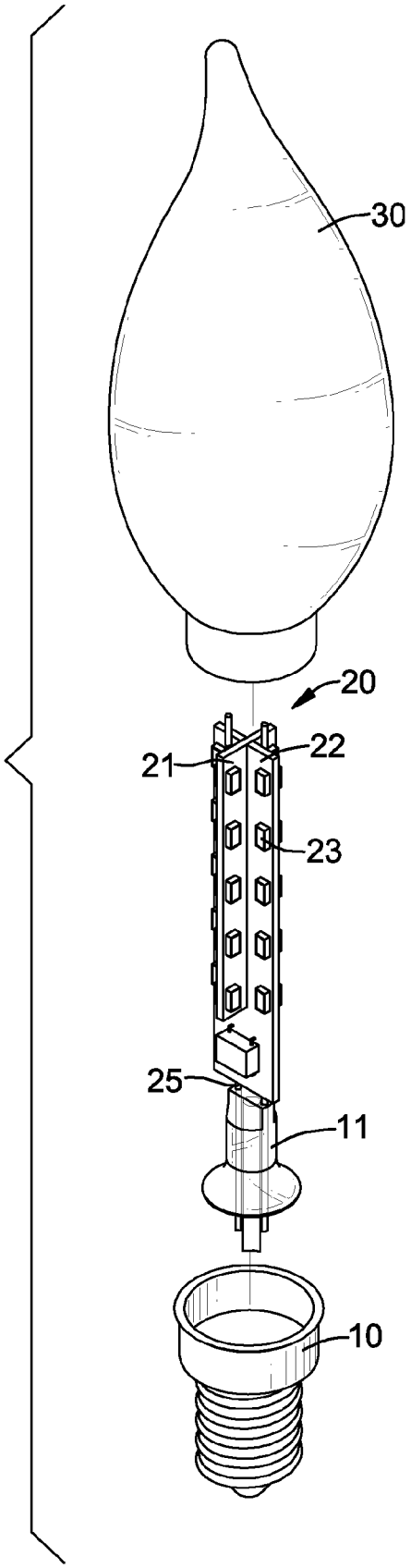
FIG. 1 is an exploded perspective view of a first embodiment of an LED lighting device in accordance with the present invention.
Figure 2:
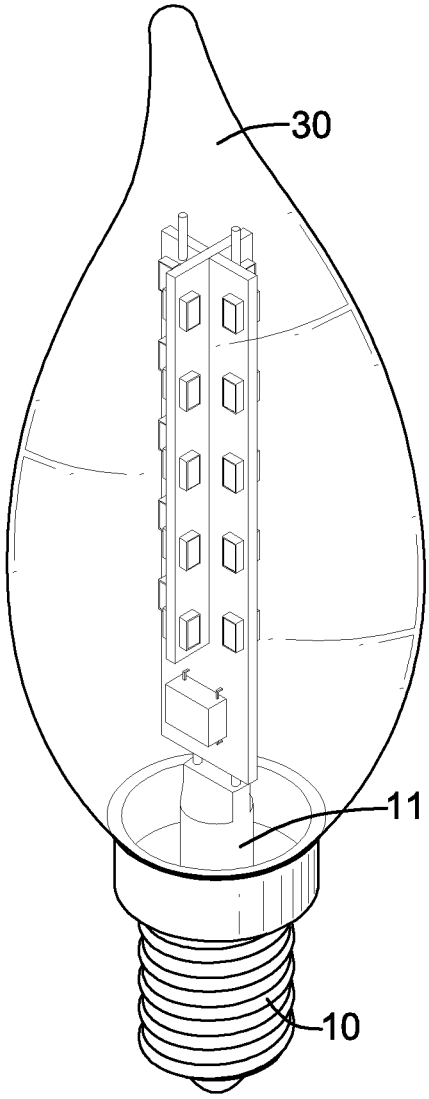
FIG. 2 is an assembled perspective view of the LED lighting device of FIG. 1.
Figure 3:
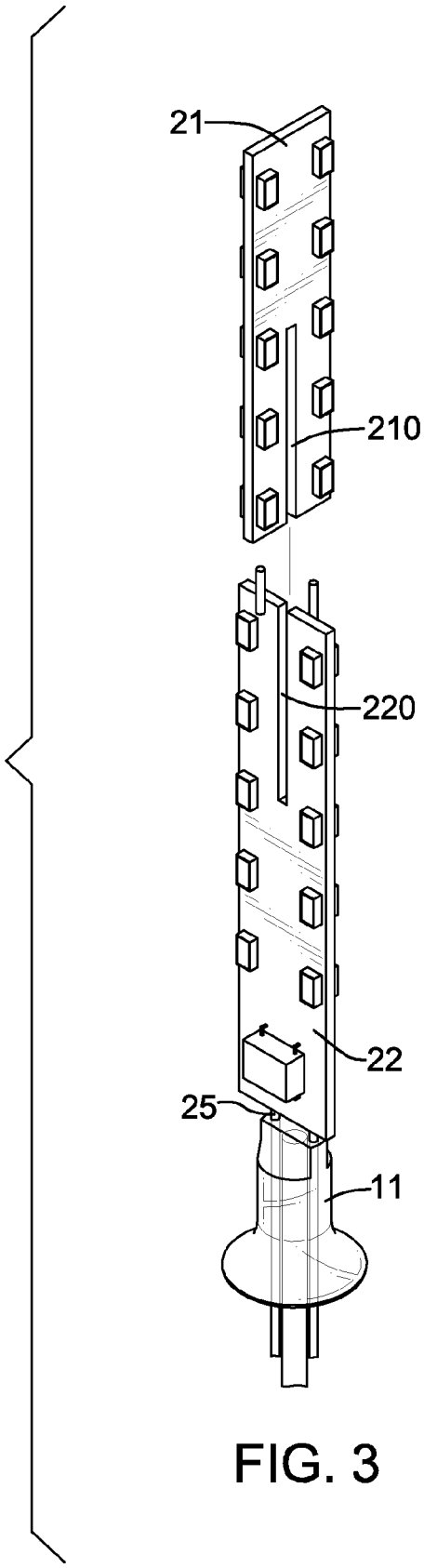
FIG. 3 is an exploded perspective view of a first embodiment of a circuit board assembly in the LED lighting device in accordance with the present invention.

With reference to FIG. 1, a first embodiment of an LED lighting device of the present invention comprises a cap 10, a circuit board assembly 20 and a bulb envelope 30.

The cap 10 has an inner space to hold a base 11. The cap 10 is made of conductive material and may have a screwed outer surface to electrically connect to a socket. The base 11 is an insulative base, for example a glass base.

With further reference to FIGS. 4 to 9, the circuit board assembly 20 is mounted on the base 11 and electrically connected to the cap 10. The circuit board assembly 20 has different embodiments in the present invention and preferably comprises multiple circuit boards 21, 22 and multiple LEDs 23. The circuit boards 21, 22 intersect each other to form a light frame with a crisscross section. Each of the circuit boards 21, 22 may have a slot 210, 220 so that the circuit boards 21,22 intersect each other by the slots 210, 220 to form the light frame. The circuit boards 21, 22 may be aluminum printed circuit boards (PCB) with high heat dissipation ability. The LEDs 23 are mounted on two opposite surfaces of each circuit board 21, 22. Preferably, the LEDs 23 are arranged in a straight line near the longitudinal edge of each circuit board 21, 22. The circuit board assembly 20 may further comprise terminals or wires 25 that extend through the base 11 and electrically connect to the cap 10 for conducting power.

Figure 4:
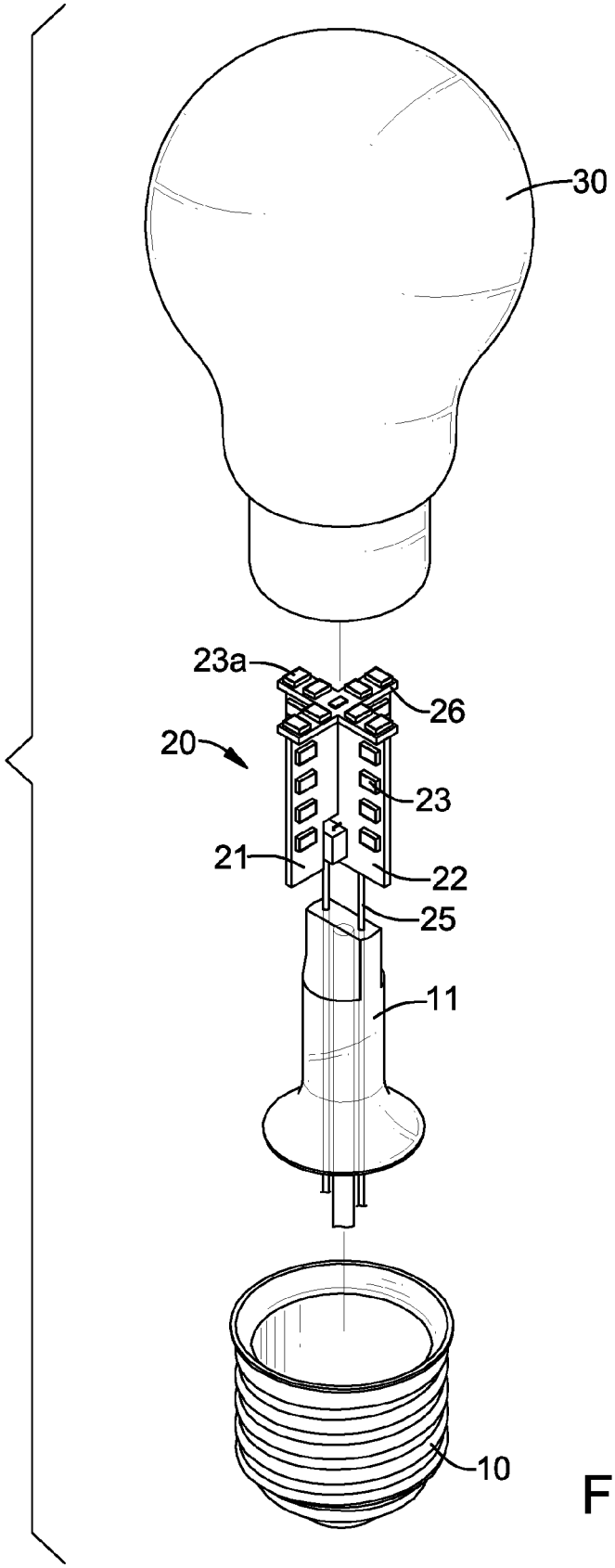
FIG. 4 is an exploded perspective view of a second embodiment of an LED lighting device in accordance with the present invention.
Figure 5:
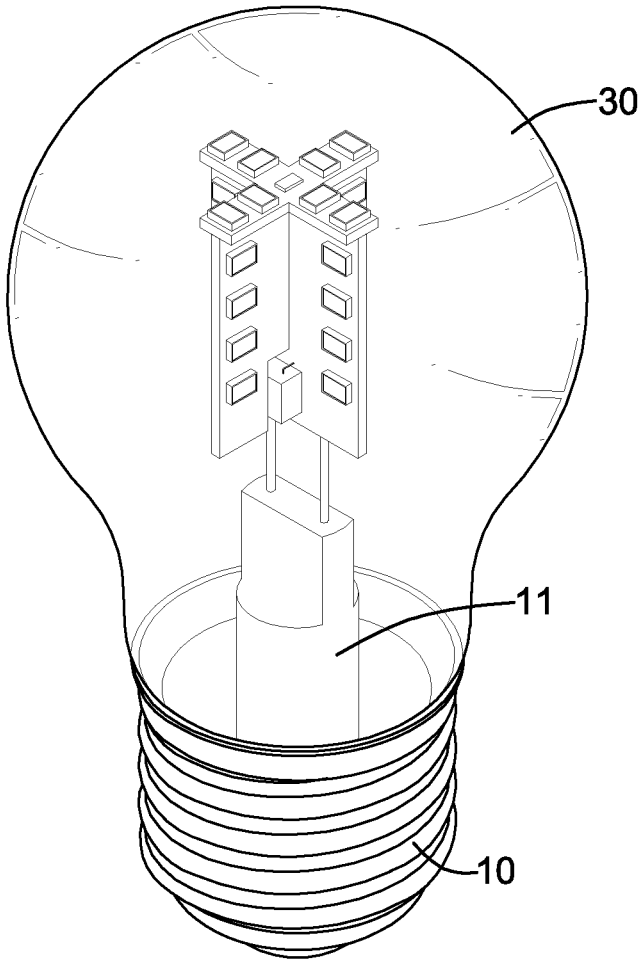
FIG. 5 is an assembled perspective view of the LED lighting device of FIG. 4.

The bulb envelope 30 is securely mounted around the cap 30 and not limited to a particular shape. For example, the shape of the bulb envelope 30 may be a candle fire as shown in FIG. 1 or a ball as shown in FIG. 4.

Figure 6:
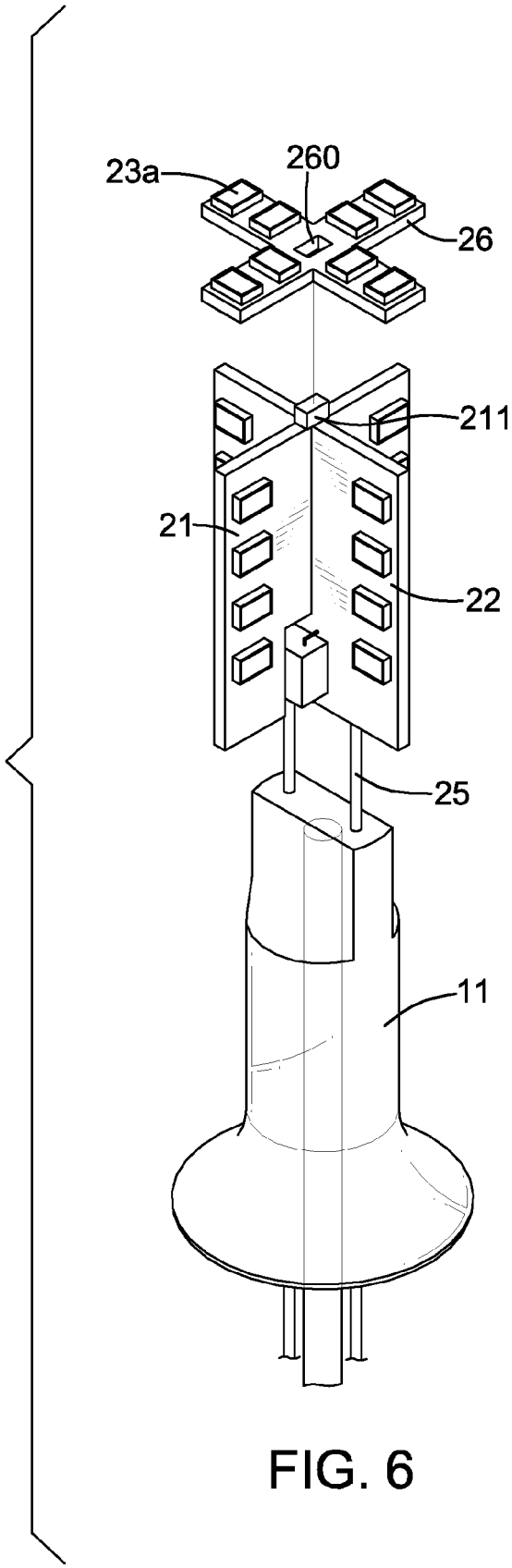
FIG. 6 is a partial exploded perspective view of a second embodiment of a circuit board assembly of the LED lighting device in accordance with the present invention.
Figure 7:
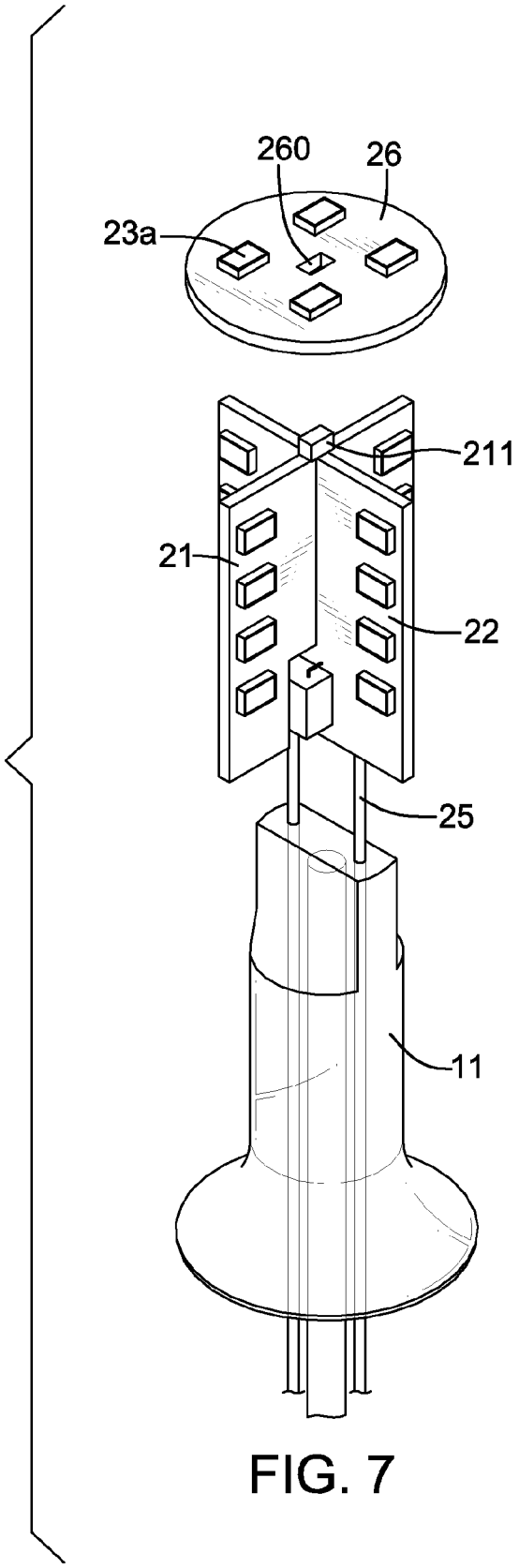
FIG. 7 is a partial exploded perspective view of a third embodiment of a circuit board assembly of the LED lighting device in accordance with the present invention.
Figure 8:
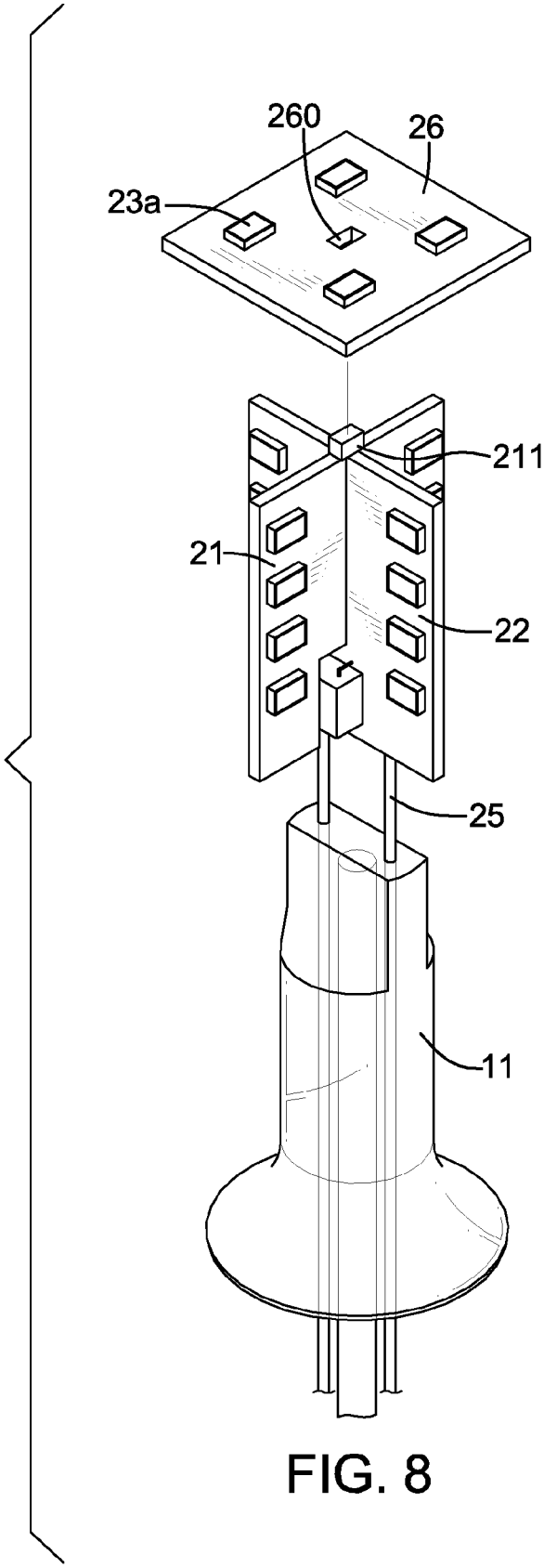
FIG. 8 is a partial exploded perspective view of a fourth embodiment of a circuit board assembly of the LED lighting device in accordance with the present invention.

The circuit board assembly 20 can further comprise a top circuit board 26 mounted on one end of the light frame opposite to the base 11. The top circuit board 26 is electrically connected to the circuit boards 21, 22 and has multiple LEDs 23*a* mounted thereon to increase illuminating area and enhance the lighting effect. The top circuit board 26 can be, but not limited to, crisscross, circular, rectangular as shown in FIGS. 6 to 8. To reinforce the connection between the top circuit board 26 and the light frame, one end of the light frame may have a protrusion 211 and the top circuit board 26 have a through hole 260 mounted around the protrusion 211 correspondingly. The protrusion 211 may be formed on the top edge of one of the circuit boards 21, 22.

Figure 9:
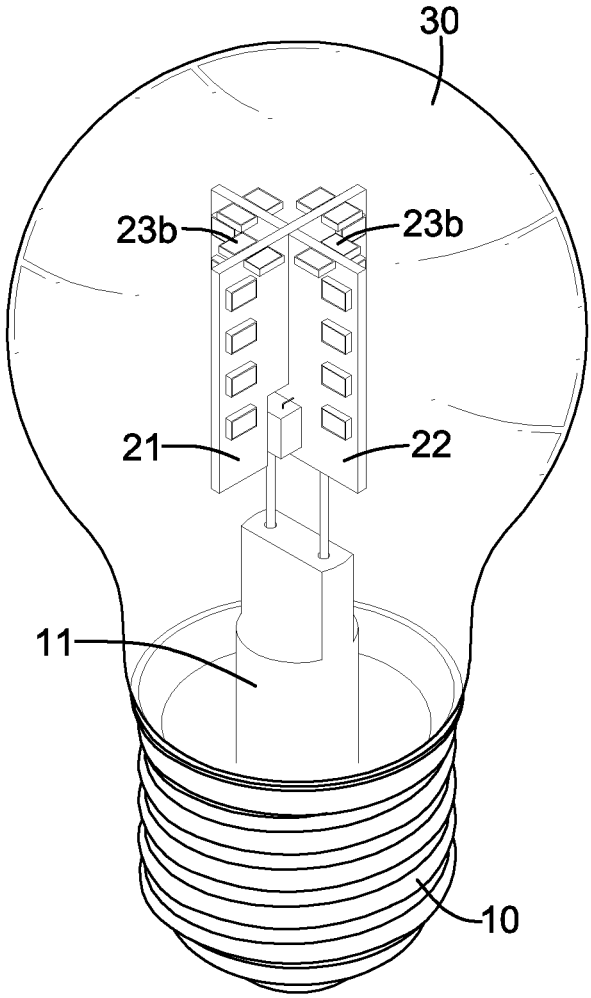
FIG. 9 is a perspective view of a fifth embodiment of a circuit board assembly mounted in the LED lighting device in accordance with the present invention.
Figure 10:
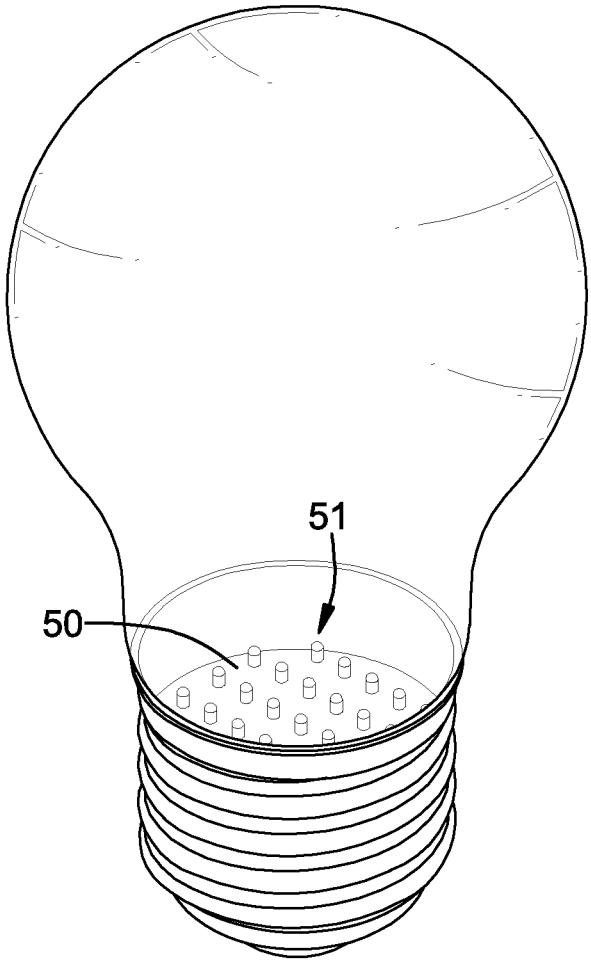
FIG. 10 PRIOR ART
FIG. 10 is a perspective view of a conventional LED lamp.

With further reference to FIG. 9, the circuit board assembly 20 may further comprise multiple top LEDs 23*b* perpendicularly mounted near a top edge of each circuit board 21, 22 opposite to the base 11. Therefore, the top LEDs 23*b* near the top edge project in one direction opposite to the base 11 and different from the directions of light emitted by the LEDs 23 mounted near the longitudinal edge. Since the lights emitted by the top LEDs 23*b* near the top edge and generated by the LEDs 23 near the longitudinal edge are orthogonal, this arrangement allows the LED lighting device to generate a wider illumination area.

From the above description, it is noted that the present invention has the following advantages.

1. Large surface for mounting LEDs

The circuit boards 21, 22 of the circuit board assembly 20 are arranged to form a three-dimensional light frame with a surface large enough for mounting a lot number of LEDs to enhance intensity of illuminating light and provides a wide angle illumination.

2. Excellent heat dissipation effect

Because the group of LEDs aligned in one circuit board is separated from another group mounted in another circuit board by a space, the generated heat can be dissipated efficiently.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An LED lighting device comprising:

a cap having a top opening and an inner space communicating with the top opening;

an insulative base mounted in the inner space and protruding upward from the top opening of the cap;

a circuit board assembly mounted on a top of the insulative base and having multiple rectangular circuit boards intersecting each other to form a light frame with a crisscross section, wherein the light frame is mounted on the insulative base and above the top opening of the cap; and multiple LEDs mounted on two opposite surfaces near a longitudinal edge of each circuit board and emitting light toward different directions;

a top circuit board mounted on a top of the light frame opposite to the insulative base and electrically connecting to the circuit boards, and multiple LEDs mounted on the top circuit board;

a bulb envelope securely mounted on the cap and enclosing the circuit board assembly and the base.

2. The LED lighting device as claimed in claim 1, wherein the top circuit board is crisscross.

3. The LED lighting device as claimed in claim 2, wherein the circuit board assembly further has a protrusion formed on the top of the light frame, and the top circuit board has a through hole mounted around the protrusion.

4. The LED lighting device as claimed in claim 3, wherein the protrusion of the light frame is formed on a top edge of one of the circuit boards.

5. The LED lighting device as claimed in claim 1, wherein the top circuit board is circular.

6. The LED lighting device as claimed in claim 5, wherein the circuit board assembly further has a protrusion formed on the top of the light frame, and the top circuit board has a through hole mounted around the protrusion.

7. The LED lighting device as claimed in claim 6, wherein the protrusion of the light frame is formed on a top edge of one of the circuit boards.

8. The LED lighting device as claimed in claim 1, wherein the top circuit board is rectangular.

9. The LED lighting device as claimed in claim 8, wherein the circuit board assembly further has a protrusion formed on the top of the light frame, and the top circuit board has a through hole mounted around the protrusion.

10. The LED lighting device as claimed in claim 9, wherein the protrusion of the light frame is formed on a top edge of one of the circuit boards.

11. The LED lighting device as claimed in claim 1, wherein the circuit board assembly further has a protrusion formed on the top of the light frame, and the top circuit board has a through hole mounted around the protrusion.

12. The LED lighting device as claimed in claim 11, wherein the protrusion of the light frame is formed on a top edge of one of the circuit boards.

13. The LED lighting device as claimed in claim 1, wherein the circuit board assembly further has multiple top LEDs mounted near a top edge of each of the circuit boards and emitting light toward a direction opposite to the base.

14. The LED lighting device as claimed in claim 13, wherein the top LEDs are perpendicularly mounted on the circuit boards.

15. The LED lighting device as claimed in claim 13, wherein the lights emitted by the top LEDs and by the LEDs mounted near the longitudinal edge of each circuit board are in different directions orthogonal to each other.

16. The LED lighting device as claimed in claim 1, wherein the insulative base is a glass base.

17. The LED lighting device as claimed in claim 1, wherein the bulb envelope has a shape of a candle fire.

18. The LED lighting device as claimed in claim 1, wherein the bulb envelope has a shape of a ball.

19. The LED lighting device as claimed in claim 1, wherein each of the circuit boards has a slot.

* * * * *